US007437890B2

(12) United States Patent
Howard

(10) Patent No.: US 7,437,890 B2
(45) Date of Patent: Oct. 21, 2008

(54) CRYOGENIC AIR SEPARATION SYSTEM WITH MULTI-PRESSURE AIR LIQUEFACTION

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 343 days.

(21) Appl. No.: 11/330,341

(22) Filed: Jan. 12, 2006

(65) Prior Publication Data

US 2007/0157664 A1 Jul. 12, 2007

(51) Int. Cl.
*F25J 3/00* (2006.01)

(52) U.S. Cl. ..... 62/646

(58) Field of Classification Search ..... 62/643, 62/646

See application file for complete search history.

(56) References Cited

U.S. PATENT DOCUMENTS 4,555,256 A * 11/1985 Skolaude et al. ..... 62/646
5,329,776 A 7/1994 Grenier ..... 62/24
5,400,600 A 3/1995 Grenier ..... 62/25
5,426,947 A 6/1995 Grenier ..... 62/25
5,887,447 A * 3/1999 Higginbotham ..... 62/643
6,112,550 A * 9/2000 Bonaquist et al. ..... 62/646
6,178,776 B1 * 1/2001 Mahoney et al. ..... 62/654
6,212,907 B1 * 4/2001 Billingham et al. ..... 62/646
6,257,020 B1 7/2001 Tranier ..... 62/646
6,347,534 B1 * 2/2002 Ha ..... 62/646
6,536,234 B1 * 3/2003 Shah ..... 62/646
6,622,520 B1 * 9/2003 Prosser et al. ..... 62/646
6,626,008 B1 9/2003 Prosser et al. ..... 62/654
7,296,437 B2 * 11/2007 Garnier et al. ..... 62/643
2001/0052244 A1 * 12/2001 Rottmann et al. ..... 62/646
2003/0000248 A1 * 1/2003 Brostow et al. ..... 62/646

* cited by examiner

*Primary Examiner*—William C Doerrler
(74) *Attorney, Agent, or Firm*—David M. Rosenblum

(57) ABSTRACT

A method for carrying out cryogenic air separation wherein feed air is processed in three streams which are at different pressures, wherein one stream is turboexpanded to generate refrigeration and the other two streams are condensed to effect pressurized product vaporization.

8 Claims, 1 Drawing Sheet

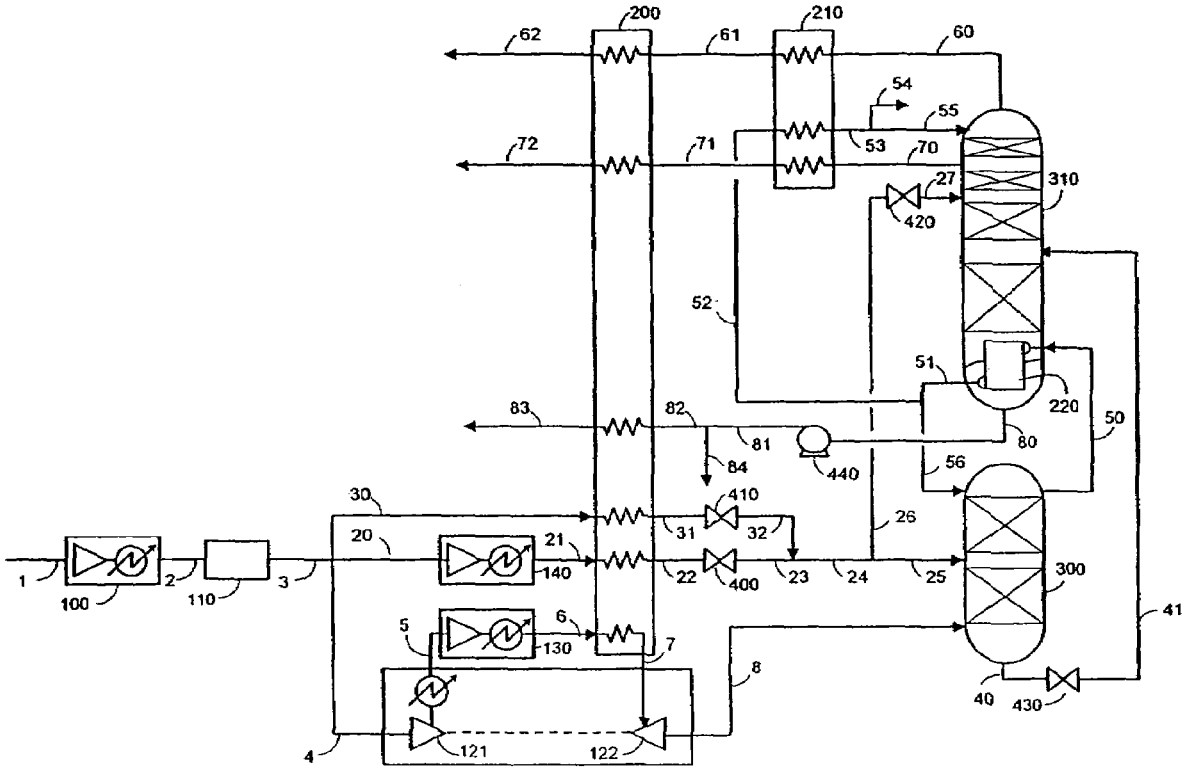
200
210
62
61
60
54
55
53
70
72
71
27
310
420
52
51
220
83
82
81
80
50
84
440
56
410
30
31
32
26
20
21
140
22
400
23
24
25
300
1
2
3
100
110
5
6
130
7
41
8
40
430
4
121
122

CRYOGENIC AIR SEPARATION SYSTEM WITH MULTI-PRESSURE AIR LIQUEFACTION

TECHNICAL FIELD

This invention relates generally to cryogenic air separation and, more particularly, to cryogenic air separation wherein feed air is condensed to vaporize a pressurized product stream.

BACKGROUND ART

Cryogenic air separation systems routinely utilize what is often referred to as liquid pumping for product pressurization. Liquid pumping refers to a direct mechanical compression of a cryogenic liquid product followed by vaporization against a warm condensing fluid. In this process, the refrigeration contained in the pumped liquefied product is imparted through indirect heat exchange to the compensating/condensing fluid. Such an approach is particularly useful for purposes of specialized product pressurization. In particular, the expense of oxygen compressors and related safety issues can be avoided through liquid oxygen pumping. There has been increased interest in processes employing full liquid pumping. In such processes oxygen is liquid pumped directly to the sendout (pipeline) pressure and vaporized within the process. The advantage of such processes stems from the complete elimination of the oxygen compressor. The complications associated with full oxygen pumping stem from the very high pressure air streams required for liquefaction. These high pressure air streams create a thermodynamic mismatch within the primary heat exchanger and hence added power consumption.

In many instances air is the preferred compensating fluid for vaporizing pumped liquid oxygen. A complication associated with full oxygen liquid pumping stems from the fact that air pressures in excess of the critical point, 547 pounds per square inch absolute (psia), are often required to vaporize the liquid oxygen. At oxygen pressures below the oxygen critical point (737 psia) substantial heat exchange inefficiencies are incurred. As a consequence, there exists substantial room for improvement in terms of heat exchange design approach. Moreover, it has been found that liquid pumped oxygen processes are not typically amenable to variable liquid production.

SUMMARY OF THE INVENTION

A method for the cryogenic separation of air comprising:

(A) compressing a first feed air stream to a first pressure, cooling the compressed first feed air stream, turboexpanding the cooled compressed first feed air stream, and passing the turboexpanded first feed air stream into a cryogenic air separation plant comprising at least one column;

(B) compressing a second feed air stream to a second pressure, condensing the compressed second feed air stream, and passing the condensed compressed second feed air stream into the cryogenic air separation plant;

(C) condensing a third feed air stream at a pressure less than the first pressure and passing the condensed third feed air stream into the cryogenic air separation plant; and (D) separating the feed air by cryogenic rectification within the cryogenic air separation plant to produce at least one of oxygen and nitrogen.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. A double column comprises a higher pressure column having its upper end in heat exchange relation with the lower end of a lower pressure column.

Vapor and liquid contacting separation processes depend on the difference in vapor pressures for the components. The higher vapor pressure (or more volatile or low boiling) component will tend to concentrate in the vapor phase whereas the lower vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "feed air" means a mixture comprising primarily oxygen, nitrogen and argon, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure fluid through a turbine to reduce the pressure and the temperature of the fluid, thereby generating refrigeration.

As used herein, the term "cryogenic air separation plant" means the column or columns wherein feed air is separated by cryogenic rectification to produce nitrogen, oxygen and/or argon, as well as interconnecting piping, valves, heat exchangers and the like.

As used herein, the term "compressor" means a machine that increases the pressure of a gas by the application of work.

As used herein, the term "subcooling" means cooling a liquid to be at a temperature lower than the saturation temperature of that liquid for the existing pressure.

BRIEF DESCRIPTION OF THE DRAWING

The sole FIGURE is a schematic representation of one preferred embodiment of the cryogenic air separation system of this invention.

DETAILED DESCRIPTION

The subject invention is an improved liquid oxygen pumped process associated with a cryogenic air separation plant employing at least one column for air separation and employing at least one turboexpander for the production of refrigeration. In particular, the subject invention provides for the use of at least two compensating or condensing air streams to facilitate oxygen vapurization. In its most preferred embodiment, the pumped oxygen vaporization occurs within the primary heat exchanger and the turboexpansion shaft work is utilized for the compression of the expansion gas. The primary liquefaction gas is preferably compressed in a dedicated and separate booster air compressor.

The invention will be described in greater detail with reference to the Drawing. Referring now to the FIGURE, feed air stream 1 is compressed in a multi-stage intercooled air compressor 100 to a substantially elevated pressure within the range of from 5 to 15 bara. Compressor 100 may be an intercooled integral gear compressor with condensate removal (not shown). Compressed feed air stream 2 is then directed to prepurification means 110. Process 110 may comprise several unit operations including but not limited to direct contact water cooling, refrigeration based chilling, direct contact with chilled water, phase separation and/or absorption. In addition, stream 2 is dehydrated and purified of high boiling contaminants (e.g. hydrocarbons, carbon dioxide and the like). This process may be accomplished by a combination of temperature and pressure swing adsorption. Process 110 produces a clean dry air stream 3 which is subsequently split into three portions.

A first portion (approximately 65 to 70 percent) of stream 3 is taken as first feed air stream 4 which is directed to turbine loaded booster compressor 121. The partially boosted and cooled air stream 5 (approximately 5 to 20 bara) is further compressed by way of compression means 130 to a first pressure within the range of from 20 to 60 bara. Resulting first feed air stream 6 is cooled in primary heat exchanger 200 to a temperature within the range of 125 to 190 K and subsequently expanded in turboexpander 122. The turbine exhaust 8 is then directed to the lower portion of column 300 as primary gaseous air feed. Column 300 is the higher pressure column of a double column which also includes lower pressure column 310. In the embodiment of the invention illustrated in the FIGURE, the cryogenic air separation plant comprises columns 300 and 310.

A second portion (20 to 25 percent) of stream 3 is taken as second feed air stream 20. This stream is further compressed in compressor 140, which may comprise multiple intercooled stages of compression, to a second pressure, which may be greater than the first pressure, and is within the range of from 25 to 70 bar. Compressed and cooled stream 21 is further cooled in heat exchanger 200 and exits substantially condensed and subcooled as stream 22. This stream may then be pressure reduced via valve 400 and directed to higher pressure column 300 by way of streams 23, 24 and 25. A portion of this stream may also be passed into lower pressure column 310 in streams 26 and 27 by way of secondary expansion valve 420.

A third portion (5 to 10 percent) of air stream 3 is taken as third feed air stream 30 at a pressure less than the first pressure. Stream 30 is preferably directed to heat exchanger 200 wherein this stream is cooled, condensed and subcooled and exits as stream 31. Stream 31 is then directed to pressure reduction means 410 (if necessary) exiting as stream 32 and then directed as feed to the column system by way of stream 24.

Columns 300 and 310 represent distillation columns in which vapor and liquid are countercurrently contacted in order to affect a gas/liquid mass-transfer based separation of the respective feed streams. Columns 300 and 310 will preferably employ packing (structured or dumped) or trays or a combination thereof.

Air streams 8 and 25 are directed to moderate pressure column 300. Column 300 serves to separate the respective streams into a nitrogen rich overhead and oxygen rich bottoms stream. The condensation of the overhead gas 50 is effected by main condenser 220. The latent heat of condensation is thereby imparted to the oxygen rich bottoms fluid of column 310. The resulting nitrogen rich liquid stream 51 is then used as a reflux liquid for both the moderate pressure column as stream 56 and for the lower pressure column 310 as stream 55. An oxygen enriched liquid 40 is also withdrawn from column 300 and is then directed through pressure reduction valve 430 prior to entry into column 310 as stream 41. Column 310 operates at a pressure in the range of 1.1 to 1.5 bara. Nitrogen rich liquid 52 is first subcooled in heat exchanger 210 and exits as stream 53 which may be split into a product liquid stream 54 and the reflux liquid stream 55 (as previously mentioned). Within column 310 streams 55, 27 and 41 are further separated into nitrogen rich overhead streams 60 and 70 and into an oxygen rich bottoms liquid 80. Nitrogen rich streams 60 and 70 are withdrawn from the upper portion of lower pressure column 310 and warmed to ambient temperature by indirect heat exchange within heat exchangers 210 and 200 sequentially, subsequently emerging as warmed lower pressure nitrogen streams 62 and 72 respectively. Stream 62 may be taken as a co-product nitrogen stream and compressed as necessary. Stream 72 may be used as a purge/sweep fluid for purposes of regenerating adsorbent systems which may form part of pre-treatment means 110 and/or vented to the atmosphere.

An oxygen rich liquid 80 is extracted from the lower portion of lower pressure column 310. This stream is then compressed by a combination of gravitational head and by mechanical pump 440. Pumped liquid oxygen stream 81 may then be split into a product liquid stream 84 (and directed to storage not shown) and stream 82. Stream 82 undergoes vaporization and warming within heat exchanger 200 and emerges as high pressure gaseous stream 83 typically at a pressure within the range from 10 to 50 bar. In a preferred embodiment condensing third feed air stream 30/31 begins condensation at a temperature lower than the bubble point temperature of pumped oxygen stream 82. Condensing second feed air stream 21/22 preferably begins condensation (or pseudo-condensation if of supercritical pressure) at a temperature above the bubble point temperature of stream 82. In so doing, the total power consumed by compressors 100, 140 and 130 is substantially reduced. There exist numerous modifications to the basic column system shown in the FIGURE. The two-pressure thermally linked double column can be used to recover both high and low purity oxygen. In addition, when recovering high purity oxygen a sidearm column can be incorporated into the design in order to affect the recovery of argon in a crude or refined state (as liquid or gas). Various ancillary heat exchange options can be employed with the basic configuration. An example would include the cooling of stream 40 against streams 61 and 71 prior to entry into column 310. If an argon sidearm column is incorporated into the column system, the oxygen rich liquid 40 can be used to refrigerate the argon condenser. Other cryogenic air distillation methods could be used in conjunction with the present invention. These include heat pumped single columns in addition to low purity oxygen cycles employing a low pressure column reboiled by the condensation (partial or otherwise) of moderate pressure feed air.

Regarding the warm end compression, compression means 140, 130 and turbine booster 121 can be incorporated in whole or in part into a combined integral gear machine. Such a machine would reduce the number of independent drive motors (or means) required of the process. The use of such a machine would still enable separate and distinct compression services.

Air liquefaction streams 20 and 30 have been used to illustrate the general intent of the present invention. It should be understood that more than one pressure level can be employed (for condensation at temperatures) both above and below the bubble point temperature of stream 82 (pumped liquid oxygen).

The disposition of the liquid air streams 22 and 31 shown in the FIGURE is not meant to be limiting. Any number of combinations are envisaged. For instance, stream 31 can be directed to columns 310 or 300 in whole or in part via conduit that is separate from that being used to transmit higher pressure liquid air stream 22. Similarly, the high pressure liquid air stream 22 can be directed in whole or in part to either column 300 and 310. Stream 30 need not be derived directly from the exit of pre-treatment means. Alternatively, it can be derived from an inter-stage location of compression means 140. The objective would be to obtain an air stream of sufficient pressure to condense at a temperature below the bubble point of stream 82.

Externally powered booster compression means 130 can be relocated to a point upstream of compressor 121 (and downstream of purification 110). For instance, stream 4 could be compressed directly by compressor means 130 prior to entry into turbine booster unit 120. Alternatively, compression means 130 may be excluded from the process or periodically bypassed.

As indicated, compression means 100 may comprise several stages of inter-cooled compression. As such, the pressure of stream 2 can be selected so that a clean dry stream of air (stream 3) is produced at a pressure comparable to that which exists at the base of column 300. In such an arrangement, a fourth stream of air can be extracted and cooled through heat exchanger 200 to near saturation and directly into column 300. Such an approach would be advantageous for a plant with lower overall liquid production needs.

It is known to the art of air separation to include multiple turbo-expansion streams. Such arrangements can be incorporated into the subject invention. For instance a portion of stream 6 could be extracted prior to the temperature level of stream 7 and expanded to a pressure near that of column 300. Such a stream could then be further cooled to near saturation in heat exchanger 200 and directed to the base of column 300 or combined with the exhaust of expander 122 stream 8. Alternatively, air streams can be expanded into the low pressure column 310.

As an additional alternative, additional minor streams of liquid oxygen or liquid nitrogen can be pumped independently to that of the primary oxygen stream and subsequently vaporized in heat exchanger 200 (in tandem with the primary oxygen stream). The key element of the invention still being a secondary condensing stream exhibiting a condensing temperature below that of the primary oxygen stream 82 representing greater than one half of the total warmed oxygen flow.

The invention claimed is:

1. A method for the cryogenic separation of air comprising:

(A) compressing a first feed air stream to a first pressure, cooling the compressed first feed air stream, turboexpanding the cooled compressed first feed air stream, and passing the turboexpanded first feed air stream into a cryogenic air separation plant comprising at least one column;

(B) compressing a second feed air stream to a second pressure, condensing the compressed second feed air stream, and passing the condensed compressed second feed air stream into the cryogenic air separation plant;

(C) condensing a third feed air stream at a pressure less than the first pressure and passing the condensed third feed air stream into the cryogenic air separation plant;

(D) separating the feed air by cryogenic rectification within the cryogenic air separation plant to produce a product comprising liquid oxygen and pumping the liquid oxygen to produce a pressurized liquid oxygen stream; and (E) vaporizing the pressurized liquid oxygen stream by passing the pressurized liquid oxygen stream in indirect heat exchange with the second feed air stream and the third feed air stream, thereby causing the condensation of the second feed air stream and the third feed air stream.

2. The method of claim 1 wherein the second pressure is greater than the first pressure.

3. The method of claim 1 wherein the cryogenic air separation plant comprises a higher pressure column and a lower pressure column.

4. The method of claim 3 wherein the first feed air stream is passed into the higher pressure column.

5. The method of claim 3 wherein at least some of the second feed air stream is passed into the higher pressure column.

6. The method of claim 3 wherein at least some of the third feed air stream is passed into the higher pressure column.

7. The method of claim 1 wherein the second feed air stream begins condensation at a temperature above the bubble point temperature of the pressurized liquid oxygen stream.

8. The method of claim 1 wherein the third feed air stream begins condensation at a temperature lower than the bubble point temperature of the pressurized liquid oxygen stream.

* * * * *